US011174691B2

(12) United States Patent
Walton et al.

(10) Patent No.: US 11,174,691 B2
(45) Date of Patent: Nov. 16, 2021

(54) TOP SET DEGRADABLE WELLBORE ISOLATION DEVICE

(71) Applicant: HALLIBURTON ENERGY SERVICES, INC., Houston, TX (US)

(72) Inventors: Zachary William Walton, Carrollton, TX (US); Michael Linley Fripp, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/750,124

(22) PCT Filed: Sep. 2, 2015

(86) PCT No.: PCT/US2015/048198

§ 371 (c)(1),
(2) Date: Feb. 2, 2018

(87) PCT Pub. No.: WO2017/039661

PCT Pub. Date: Mar. 9, 2017

(65) Prior Publication Data

US 2018/0216431 A1 Aug. 2, 2018

(51) Int. Cl.

| | |
|---|---|
| ***E21B 23/06*** | (2006.01) |
| ***E21B 33/12*** | (2006.01) |
| ***E21B 33/134*** | (2006.01) |
| ***E21B 33/13*** | (2006.01) |

(Continued)

(52) U.S. Cl.

CPC ..... *E21B 23/06* (2013.01); *C22C 23/00* (2013.01); *E21B 33/12* (2013.01); *E21B 33/128* (2013.01); *E21B 33/13* (2013.01); *E21B 33/134* (2013.01)

(58) Field of Classification Search

CPC ..... E21B 23/06; E21B 33/13; E21B 33/14; E21B 33/128; E21B 33/134; E21B 7/20; E21B 43/10; E21B 43/12; E21B 34/06; C22C 23/00

See application file for complete search history.

(56) References Cited

U.S. PATENT DOCUMENTS 5,073,527 A * 12/1991 Newkirk ..... C04B 35/10 501/120
5,791,413 A 8/1998 Buzinsky
5,944,102 A 8/1999 Kilgore et al.

(Continued)

FOREIGN PATENT DOCUMENTS

CA 2931498 A1 7/2015
CN 103160261 A 6/2013

(Continued)

OTHER PUBLICATIONS

Office Action; Canadian Application No. 2,993,521; dated Jun. 19, 2019.

(Continued)

*Primary Examiner* — George S Gray
(74) *Attorney, Agent, or Firm* — Polsinelli PC

(57) ABSTRACT

A wellbore isolation device capable of being set from the top including one or more components capable of degrading when exposed to a wellbore environment. A method and system for providing zonal isolation in a wellbore that includes a downhole degradable top-setting wellbore isolation device.

12 Claims, 6 Drawing Sheets

(51) Int. Cl.
*E21B 33/128* (2006.01)
*C22C 23/00* (2006.01)

(56) References Cited

U.S. PATENT DOCUMENTS

| | | | | |
|---|---|---|---|---|
| 6,167,963 | B1 * | 1/2001 | McMahan | E21B 33/1204 166/179 |
| 8,047,279 | B2 | 11/2011 | Barlow et al. | |
| 8,211,248 | B2 | 7/2012 | Marya | |
| 8,459,346 | B2 | 6/2013 | Frazier | |
| 8,596,347 | B2 | 12/2013 | Valencia et al. | |
| 8,905,147 | B2 | 12/2014 | Fripp et al. | |
| 2011/0048743 | A1 * | 3/2011 | Stafford | E21B 33/134 166/386 |
| 2011/0067889 | A1 * | 3/2011 | Marya | E21B 33/134 166/386 |
| 2012/0222861 | A1 | 9/2012 | Eriksen | |
| 2013/0284425 | A1 * | 10/2013 | Agrawal | E21B 23/04 166/193 |
| 2014/0110123 | A1 | 4/2014 | Murphree et al. | |
| 2014/0124216 | A1 | 5/2014 | Fripp et al. | |
| 2014/0166318 | A1 | 6/2014 | Harms | |
| 2014/0224507 | A1 | 8/2014 | Fripp et al. | |
| 2014/0251641 | A1 | 9/2014 | Marya et al. | |
| 2014/0284063 | A1 | 9/2014 | Fripp et al. | |
| 2014/0299332 | A1 | 10/2014 | Rood | |
| 2014/0332233 | A1 | 11/2014 | Walton et al. | |
| 2014/0332239 | A1 | 11/2014 | Porta | |
| 2015/0159463 | A1 * | 6/2015 | Frazier | E21B 33/134 166/193 |
| 2015/0240337 | A1 * | 8/2015 | Sherman | C22C 1/03 420/408 |
| 2015/0299838 | A1 * | 10/2015 | Doud | C22F 1/06 420/409 |
| 2016/0024619 | A1 * | 1/2016 | Wilks | E21B 34/063 166/308.1 |

FOREIGN PATENT DOCUMENTS

| | | | |
|---|---|---|---|
| CN | 103201453 | A | 7/2013 |
| CN | 104004950 | A | 8/2014 |
| CN | 104285032 | A | 1/2015 |
| CN | 104632196 | A | 5/2015 |
| CN | 204476347 | U | 7/2015 |
| WO | 20130184185 | A1 | 12/2013 |
| WO | 20140189766 | A2 | 11/2014 |
| WO | 20150017021 | A1 | 2/2015 |
| WO | 20150105515 | A1 | 7/2015 |

OTHER PUBLICATIONS

International Search Report and Written Opinion; PCT Application No. PCT/US2015/048198; dated May 18, 2016.
Office Action; Canadian Application No. 2,993,521; dated Dec. 17, 2019.
Australian Examination Report, Application No. 2015408055, dated Feb. 18, 2021.
Chinese Office Action, Application No. 201580082147.2; dated May 24, 2019.
English Abstract of CN103160261A; Retrieved from www.espacenet.com on Jun. 22, 2021.
English Abstract of CN104004950A; Retrieved from www.espacenet.com on Jun. 22, 2021.
English Abstract of CN204476347U; Retrieved from www.espacenet.com on Jun. 22, 2021.
English Abstract of CN103201453A; Retrieved from www.espacenet.com on Jun. 22, 2021.
English Abstract of CN104632196A; Retrieved from www.espacenet.com on Jun. 22, 2021.
English Abstract of CN104285032A; Retrieved from www.espacenet.com on Jun. 22, 2021.

* cited by examiner

TOP SET DEGRADABLE WELLBORE ISOLATION DEVICE

CROSS-REFERENCE TO RELATED APPLICATIONS

This application is a national stage entry of PCT/US2015/048198 filed Sep. 2, 2015, said application is expressly incorporated herein in its entirety.

FIELD

The present disclosure relates to downhole tools used to isolate portions of a subterranean wellbore. In particular, the present disclosure relates to a degradable wellbore isolation device capable of being set from the top.

BACKGROUND

Wellbores are drilled into the earth for a variety of purposes including tapping into hydrocarbon bearing formations to extract the hydrocarbons for use as fuel, lubricants, chemical production, and other purposes. In order to facilitate processes and operations in the wellbore, it may often be desirable to isolate or seal one or more portions of a wellbore. Zonal isolation within a wellbore may be provided by wellbore isolation devices, such as packers, bridge plugs, and fracturing plugs (i.e., "frac" plugs). For example, one or more wellbore isolation devices may be employed during hydraulic fracturing operations, where a high pressure frac fluid is pumped downhole in order to fracture a targeted portion of a formation for the purpose of causing hydrocarbons to be more readily extracted and produced from the formation. A wellbore isolation device can be used to isolate the target zone for the hydraulic fracturing operation by forming a pressure seal in the wellbore that prevents the high pressure frac fluid from extending downhole of the wellbore isolation device.

After the downhole operation requiring zonal isolation has been completed, it is often necessary to remove the wellbore isolation device from the wellbore in order to allow hydrocarbon production operations to proceed without being hindered by the presence of the downhole tool. The removal of one or more wellbore isolation devices from the wellbore often involves milling or drilling the wellbore isolation device(s) into pieces followed by retrieval of the pieces of the wellbore isolation device from the wellbore. In order to facilitate such operations, many wellbore isolation devices have been manufactured using millable metal materials such as cast iron, brass, or aluminum, or are made from softer composite materials. However, operations to remove wellbore isolation devices from the wellbore by milling are costly and time-consuming as they require introducing a tool string (e.g., a mechanical connection to the surface) into the wellbore. In addition to increasing the completion costs of a well, milling operations can produce damage to the metal casing that lines the wellbore. Further, since milling tools are frequently conveyed on coiled tubing, which has a finite effective reach in horizontal wellbores, the lateral length of wellbores may be limited by the need to mill out wellbore isolation devices during well completion.

Wellbore isolation devices are set in the wellbore by a setting tool. For instance, the wellbore isolation device is run into the wellbore coupled to a setting tool, which is in turn coupled to a conveyance. When the wellbore isolation device is positioned at the desired depth in the wellbore, the setting tool causes the actuation of the slip and seal assemblies on the wellbore isolation device, thereby setting the wellbore isolation device against the wall of the wellbore.

The most commonly used setting tools set the wellbore isolation device from the top by pulling the tubular body, or mandrel, of the wellbore isolation device in the uphole direction. The setting tool generates a large amount of force, often in excess of 20,000 lbs, producing significant tension on the tubular body of the wellbore isolation device. The tension in the tubular body of the wellbore isolation device, produced by the setting tool, causes the seal and one or more slips to radially extend against the wall of the wellbore or casing, thereby setting the wellbore isolation device and establishing a zonal isolation seal. Various types of setting tools exist. Some setting tools are activated by hydrostatic or hydraulic pressure. However, some of the most commonly used setting tools, such as the Model E-4 Wireline Pressure Setting Assembly (Baker Hughes) and the "Shorty" (Halliburton Energy Services), are explosive setting tools that are activated by means of a pyrotechnic or black powder charge.

In order to reduce the cost and time required to mill and remove a wellbore isolation device from the wellbore, wellbore isolation devices with components manufactured from degradable materials may be desirable. However, degradable wellbore isolation devices may not be strong enough to be set from the top, using commonly used setting tools, due to the tension placed on the tubular body or mandrel during the setting process. Instead, wellbore isolation devices made of degradable materials are set from the bottom using non-standard setting tools which exert compression on the tubular body during the setting process. Bottom-setting wellbore isolation devices also require a more complicated construction, require more material to be conveyed downhole, and are characterized by a higher risk of setting failure.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
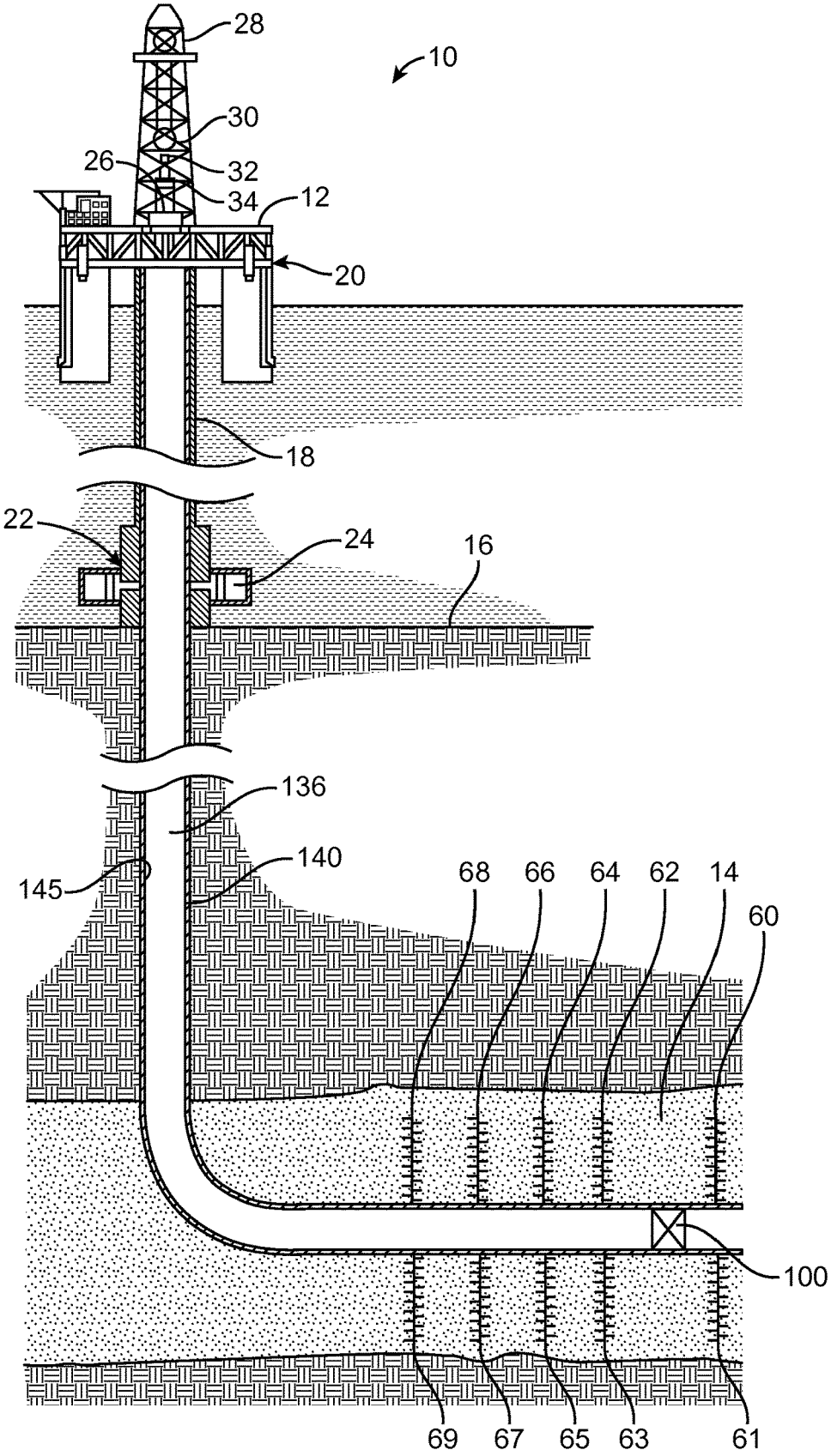
FIG. 1 is a schematic diagram of an embodiment of a wellbore operating environment in which a degradable wellbore isolation device may be deployed.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed apparatus, methods, and systems may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the term "couple," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "upper," or "uphole" meaning toward the surface of the wellbore and with "lower," or "downhole" meaning toward the terminal end of the well, regardless of the wellbore orientation. The various characteristics described in more detail below, will be readily apparent to those skilled in the art with the aid of this disclosure upon reading the following detailed description, and by referring to the accompanying drawings.

The present disclosure generally relates to a degradable wellbore isolation device capable of being set from the top. More particularly, the present disclosure relates to a top-setting wellbore isolation device that is at least partially comprised of a downhole degradable metal.

Wellbore isolation devices are used to provide zonal isolation within a wellbore in order to facilitate various processes and operations in the wellbore. One use of a wellbore isolation device is to isolate a targeted zone of a formation for hydraulic fracturing operations by forming a pressure seal in the wellbore downhole of the target zone. After the hydraulic fracturing operation has been completed, it is often necessary to remove the wellbore isolation device from the wellbore. A wellbore isolation device that is at least partially made of a downhole degradable metal does not require coiled tubing intervention in the form of milling to remove the wellbore isolation device from the wellbore. Instead, production operations may be efficiently undertaken once the downhole degradable metal has sufficiently degraded in the wellbore environment such that the seal between the degradable wellbore isolation device and the wellbore wall is broken and the degraded device does not pose a significant obstruction to fluid flow. Further, a degradable wellbore isolation device including a tubular body made of a downhole degradable metal, as disclosed herein, has sufficient strength to be set from the top using standard setting tools while having a tubular body with sufficient internal diameter to provide for flow back and immediate production.

As used herein, the term "degradable" and all of its grammatical variants (e.g., "degrade," "degradation," "degrading," and the like) refers to the dissolution or chemical conversion of solid materials such that reduced-strength solid end-products result by at least one of solubilization, hydrolytic degradation, chemical reactions (including electrochemical and galvanic reactions), or thermal reactions. In complete degradation, no solid end-products result or the end-products are so small as to be irrelevant to the operation of the wellbore. In some instances, the degradation of the material may be sufficient for the mechanical properties of the material to be reduced to a point that the material no longer maintains its integrity and, in essence, falls apart or sloughs off to its surroundings.

As used herein, the term "downhole degradable metal" refers to a metal that is degradable in the wellbore environment. The term "wellbore environment" includes both naturally occurring wellbore environments and materials or fluids introduced into the wellbore. The degradable metal can degrade in wellbore environments present during conventional downhole operations or can degrade in wellbore conditions where an external stimulus may be used to initiate or affect the rate of degradation. For instance, a fluid containing an electrolyte may be introduced into the wellbore to initiate degradation. In other instances, the wellbore environment may naturally include the electrolyte in sufficient concentration to initiate degradation. In another example, the pH of the wellbore fluid that interacts with the downhole degradable metal may be changed by the introduction of an acid or a base to the wellbore environment. In some cases, the wellbore environment comprises an aqueous solution containing electrolytes at a temperature of at least 65° C.

The downhole degradable metals described herein may degrade by galvanic corrosion in the presence of an electrolyte. As used herein, the term "electrolyte" refers to a conducting medium containing ions (e.g., a salt). The electrolyte can be selected from the group consisting of, solutions of an acid, a base, a salt, and combinations thereof. Galvanic corrosion occurs when two different metals or metal alloys are in electrical connectivity with each other and both are in contact with an electrolyte. The term "galvanic corrosion" includes microgalvanic corrosion. As used herein, the term "electrical connectivity" means that the two different metals or metal alloys are either touching or in close proximity to each other such that when contacted with an electrolyte, the electrolyte becomes electrically conductive and ion migration occurs between one of the metals and the other metal.

The electrolyte can be a fluid that is introduced into the wellbore or a fluid emanating from the wellbore, such as from a surrounding subterranean formation. In some cases, the electrolyte may be a halide anion (i.e., fluoride, chloride, bromide, iodide, and astatide), a halide salt, an oxoanion (including monomeric oxoanions and polyoxoanions), and any combination thereof. Suitable examples of halide salts for use as the electrolytes of the present disclosure may include, but are not limited to, a potassium fluoride, a potassium chloride, a potassium bromide, a potassium iodide, a sodium chloride, a sodium bromide, a sodium iodide, a sodium fluoride, a calcium fluoride, a calcium chloride, a calcium bromide, a calcium fluoride, a zinc chloride, a zinc bromide, a zinc iodide, an ammonium fluoride, an ammonium chloride, an ammonium bromide, an ammonium iodide, a magnesium chloride, potassium carbonate, potassium nitrate, sodium nitrate, and any combination thereof. The oxyanions for use as the electrolyte of the present disclosure may be generally represented by the formula $A_xO_y^{z-}$, where A represents a chemical element and O is an oxygen atom; x, y, and z are integers between the range of about 1 to about 30, and may be or may not be the same integer. Examples of suitable oxoanions may include, but are not limited to, carbonate, borate, nitrate, phosphate, sulfate, nitrite, chlorite, hypochlorite, phosphite, sulfite, hypophosphite, hyposulfite, triphosphate, and any combination thereof.

In some cases, the electrolyte may be present in an aqueous base fluid including, but not limited to, fresh water, saltwater (e.g., water containing one or more salts dissolved therein), brine (e.g., saturated salt water), seawater, and any combination thereof. Generally, the water in the aqueous base fluid may be from any source, provided that it does not interfere with the electrolyte therein from degrading at least partially the downhole degradable metal forming at least a component of the wellbore isolation device. As used herein, the term "degrading at least partially" or "partially degrades" refers to the tool or component that degrades at least to the point wherein 20% of more of the mass of the tool or component degrades.

FIG. 1 illustrates a schematic view of an embodiment of a wellbore operating environment in which a degradable wellbore isolation device may be deployed. As depicted, the operating environment 10 includes a semi-submersible platform 12 centered over a submerged oil and gas formation 14 located below the sea floor 16. A subsea conduit 18 extends from the deck 20 of the platform 12 to wellhead installation 22, including blowout preventers 24. Platform 12 has a hoisting apparatus 26, a derrick 28, a travel block 30, a hook 32 and a swivel 34 for raising and lowering pipe strings.

A wellbore 136 extends through various earth strata including formation 14 and has a casing 140 cemented therein. As shown, wellbore 136 includes a substantially horizontal portion extending through formation 14. The substantially horizontal portion of the wellbore 136 maximizes exposed wellbore length through formation 14. Due to the length of the substantially horizontal portion of wellbore 136, it can be preferable to perform the perforating and fracturing operation in stages. For example, each stage may be several hundred feet in wellbore length.

Disposed in a substantially horizontal portion of the wellbore 136 is a degradable wellbore isolation device 100 capable of being set from the top. The degradable wellbore isolation device 100 includes one or more components that are at least partially composed of a downhole degradable metal described herein. The degradable wellbore isolation device may be any type of wellbore isolation device capable of fluidly sealing two sections of the wellbore from one another and maintaining differential pressure (i.e., to isolate one pressure zone from another) and that is capable of being set in the wellbore from the top in response to tension applied to the tubular body of the degradable wellbore isolation device. Examples of suitable wellbore isolation devices may include, but are not limited to, a frac plug, a bridge plug, a packer, a ball plug, a wiper plug, a cement plug, a basepipe plug, a sand control plug, and any combination thereof.

The degradable wellbore isolation device 100 can have one or more components made of a downhole degradable metal, including, but not limited to, the tubular body or mandrel of a packer or a plug, a slip, a seal, a sealing element, a wedge, a spacer ring, a retainer ring, a ball, a ball seat, a flapper, a housing, a flow control device or plug, an extrusion limiter or backup shoe, a mule shoe, or any other wellbore isolation device component thereof.

In some cases, the radially extendible elastomeric sealing surface disposed on the seal can be comprised of a material capable of degrading when exposed to a wellbore environment. For example, the extendible elastomeric sealing surface may be at least partially composed of an aqueous-degradable elastomer that degrades, at least in part, in the presence of an aqueous fluid, such as preexisting aqueous fluids or introduced aqueous fluids in the wellbore environment.

As shown in FIG. 1, the degradable wellbore isolation device 100 has been set in the wellbore 136 between a first stage and a second stage of a hydraulic fracturing operation. The first stage of the hydraulic fracturing operation produced at least fractures 60, 61 in formation 14. Subsequent to the completion of the first stage of the hydraulic fracturing operation, the degradable wellbore isolation device 100 is set in the wellbore 136 in order to provide zonal isolation for the second stage of the hydraulic fracturing operation. After the degradable wellbore isolation device 100 is set in the wellbore 136, the second stage of the hydraulic fracturing operation commences, including perforating a portion of the wellbore 136 uphole of the wellbore isolation device 100, followed by pumping fracture fluid at sufficiently high pressure to generate fractures 62, 63, 64, 65, 66, 67, 68, 69 in formation 14.

In some cases, the perforating of a stage can be conducted prior to zonally isolating the stage of the wellbore 136 by setting the degradable wellbore isolation device 100. In such cases, the degradable wellbore isolation device 100 can be set in the wellbore 136 after perforating the stage but prior to the hydraulic fracturing of the stage. In some cases, the perforating and fracturing operation for a wellbore such as wellbore 136 may have ten to fifty stages or more, depending upon the length of the wellbore and the length of each stage.

Although only one degradable wellbore isolation device 100 is depicted in FIG. 1, a plurality of degradable wellbore isolation devices 100 may be placed in the wellbore 136. In some cases, several (e.g., six or more) degradable wellbore isolation devices 100 may be arranged in the wellbore 136 to divide the wellbore into smaller intervals or "zones" for hydraulic fracturing operations. As shown in FIG. 1, the degradable wellbore isolation device 100 may be set in a cased hole, in which steel tubing or pipe ("casing" 140) defines the wellbore wall 145. However, the degradable wellbore isolation device 100 may also be set in an uncompleted, or "open-hole" environment. In other instances, the wellbore 136 may be lined with another type of wellbore liner or tubing in which in which the degradable wellbore isolation device 100 may be suitably set. Additionally, the degradable wellbore isolation device 100 may be set in a wellbore 136 where the inner wall of the wellbore 145 is defined by tubing or other conduits known in the art. The degradable wellbore isolation device 100 may be used in direct contact with the formation face of the wellbore, with casing string, with a screen or wire mesh, and the like.

Following the completion of the hydraulic fracturing operations, or other completion and/or stimulation operations, the degradable wellbore isolation device 100 must be removed from the wellbore 136 in order to allow production operations to effectively occur without being hindered by the emplacement of the degradable wellbore isolation device 100. According to the present disclosure, one or more components of the degradable wellbore isolation device 100 can be made of one or more downhole degradable metals. Therefore the degradable wellbore isolation device 100 can be removed from the wellbore 136 by degradation of one or more components of the degradable wellbore isolation device 100 as a result of exposure to the wellbore environment. In addition, production operations may be undertaken while the degradable wellbore isolation device 100 is degrading, as long as the degrading wellbore isolation device 100 does not create a significant pressure restriction in the wellbore 136.

In some cases, the downhole degradable metal, comprising one or more components of the degradable wellbore isolation device 100, can be selected based upon a desired degradation rate of the degradable wellbore isolation device 100 for the particular wellbore environment. For example, more slowly degrading downhole degradable metals may allow for more time between the setting of the degradable wellbore isolation device 100 in the wellbore 136 and when a desired completion or stimulation operation is undertaken, such as a hydraulic fracturing operation. Additionally, more slowly degrading downhole degradable metals may allow for acid stimulation operations while the wellbore isolation device provides zonal isolation. In some instances, more slowly degrading downhole degradable metals may be less expensive than more rapidly degrading downhole degradable metals.

In some cases, the degradable wellbore isolation device 100 degrades upon exposure to an electrolyte fluid produced from the formation 14 or wellbore 136. In other cases, the degradable wellbore isolation device 100 degrades upon exposure to an introduced electrolyte fluid in the wellbore environment. The foregoing descriptions of examples of wellbore conditions resulting in removal of the degradable wellbore isolation device 100 from the wellbore are presented for purposes of illustration and description and are not intended to be exhaustive or to limit this disclosure to the precise forms disclosed, as many other variations are possible.

Removal of the degradable wellbore isolation device 100 by degradation of one or more components of the degradable wellbore isolation device 100 is more cost effective and less time consuming than coiled tubing intervention to mill or drill out the wellbore isolation device, which requires making one or more trips into the wellbore.

Even though FIG. 1 depicts a horizontal wellbore 136, the present disclosure is equally well-suited for use in wellbores having other orientations including vertical wellbores, slanted wellbores, multilateral wellbores or the like. Also, even though FIG. 1 depicts an offshore operation, the present disclosure is equally well-suited for use in onshore operations. Further, even though FIG. 1 depicts a cased hole completion, the present disclosure is equally well-suited for use in open hole completions.

Figure 2:
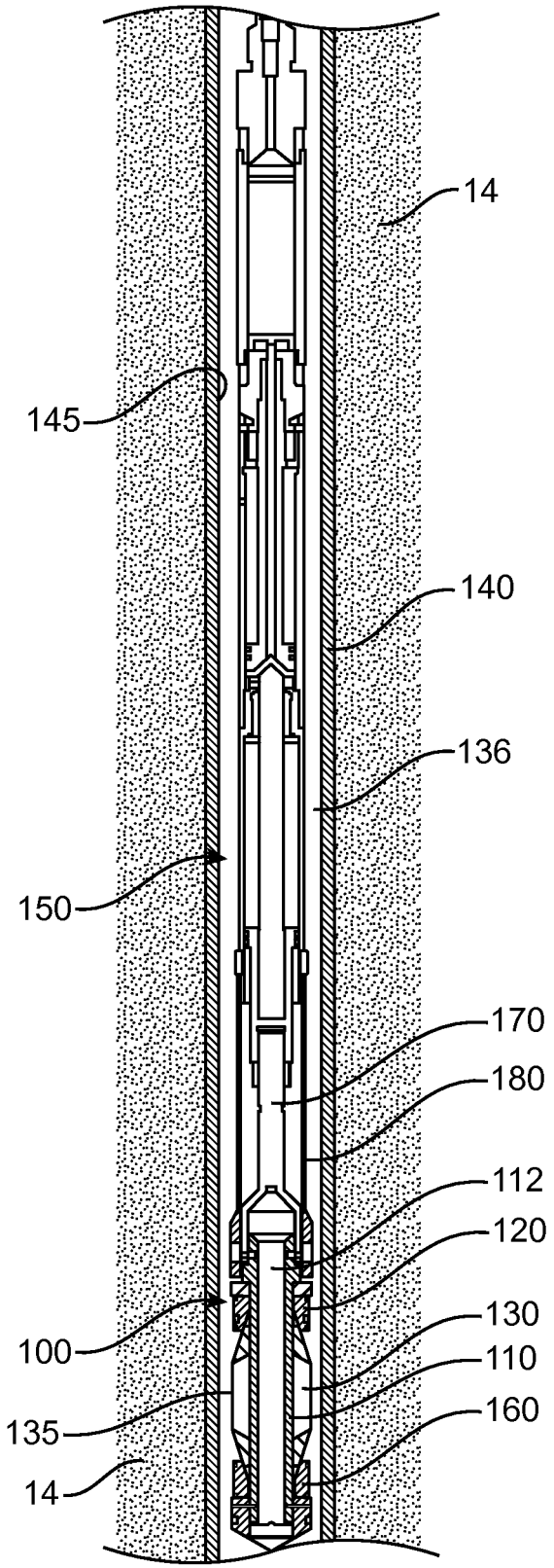
FIG. 2 is a sectional view of a degradable wellbore isolation device coupled to a setting tool, according to an exemplary embodiment.

FIG. 2 illustrates a sectional view of a degradable wellbore isolation device 100 capable of being set from the top by setting tool 150. As shown in FIG. 2, the degradable wellbore isolation device 100 is in the un-set position while being run into the wellbore 136 and prior to being set at the desired wellbore depth. While the degradable wellbore isolation device 100 is lowered into the wellbore 136 to a desired setting depth, the degradable wellbore isolation device 100 is coupled with a setting tool 150.

The wellbore 136 extends through formation 14 and has a casing 140 cemented therein. The degradable wellbore isolation device 100 includes a tubular body 110 that has a first end oriented in the uphole direction of the wellbore and a second end oriented in the downhole direction of the wellbore. The first end of the tubular body 110 is coupled with the shear rod 170 of the top setting tool 150. The tubular body 110 includes an external surface 115 and has an inner bore 112 formed therein. In some cases, the inner bore 112 of the tubular body 110 is capable of allowing fluid flow in at least one direction. In other cases, the inner bore 112 of the tubular body 110 is sealed at both ends preventing fluid flow through the inner bore 112. In some cases, the tubular body 110 can be a mandrel. The degradable wellbore isolation device 100 also includes an upper slip 120, lower slip 160, and seal 130 disposed about the external surface 115 of the tubular body 110.

The degradable wellbore isolation device 100 comprising a downhole degradable metal can be of any design as long as it is strong enough to be set from the top while effectively providing zonal isolation during downhole operations. For instance, the tubular body 110 may comprise any downhole degradable metal that is strong enough to allow the degradable wellbore isolation device 100 to be set from the top in response to tension applied to the tubular body 110 by setting tool 150.

According to the present disclosure, the tubular body 110 of the degradable wellbore isolation device 100 can be made of or otherwise comprise a downhole degradable metal capable of degrading in the wellbore environment. The upper limit of the inner diameter of the tubular body 110 may be dependent on the structural limitations of the degradable wellbore isolation device 100 and, more particularly, the structural limitations of the tubular body 110. For instance, the inner diameter may be any diameter as long as the tubular body 110 is able to adequately hold or maintain pressure loads that may occur during downhole operations and is able to be set from the top. In some cases, the tubular body 110 has an inner diameter that is at least 25% of the outer diameter of the tubular body 110. The tubular body 110 may be a mandrel. In some cases, other components of the degradable wellbore isolation device 100 may be made of or otherwise comprise a downhole degradable metal.

In some cases, the radially extendible elastomeric sealing surface 135 disposed on the seal 130 can be comprised of a material capable of degrading when exposed to a wellbore environment. For example, the elastomeric sealing surface 135 may be at least partially composed of an aqueous-degradable elastomer that degrades, at least in part, in the presence of an aqueous fluid, such as preexisting aqueous fluids or introduced aqueous fluids in the wellbore environment. The aqueous-degradable elastomer, forming at least a portion of the elastomeric sealing surface 135, may wholly degrade or partially degrade, and may degrade by a number of mechanisms. For example, the elastomeric sealing surface 135 may degrade by swelling, dissolving, undergoing a chemical change, undergoing thermal degradation in combination with any of the foregoing, and any combination thereof. Thermal degradation may work in concert with one or more of the other degradation methods that occurs when the elastomeric sealing surface 135 encounters an aqueous fluid.

The aqueous-degradable elastomer forming at least a portion of the elastomeric sealing surface 135 may be a material that is at least partially aqueous-degradable, including, but not limited to, a polyurethane rubber, a polyester-based polyurethane rubber, a blend of chlorobutadiene rubber, reactive clay, and crosslinked sodium polyacrylate, a cellulose-based rubber (e.g., carboxy methyl cellulose), an acrylate-based polymer, a polyethylene glycol-based hydrogel, a silicone-based hydrogel, a polyacrylamide-based hydrogel, a polymacon-based hydrogel, a hyaluronic acid rubber, a polyhydroxobutyrate rubber, a polyester elastomer, a polyester amide elastomer, a polyamide elastomer, and any copolymers or terpolymers thereof, as well as any combination thereof. Examples of suitable copolymers and terpolymers may include, but are not limited to, a cellulose-based rubber and an acrylate rubber copolymer, a cellulose-based rubber, an acrylate rubber, and an acrylonitrile butadiene rubber terpolymer, an acrylate rubber and an acrylonitrile butadiene rubber copolymer, a cellulose-based rubber and an acrylonitrile butadiene rubber copolymer, and any combination thereof.

As depicted in FIG. 2, the degradable wellbore isolation device 100 is coupled with a setting tool 150 while it is being lowered in the wellbore 136 to a setting depth. The setting tool 150 can be any setting tool capable of setting the degradable wellbore isolation device 150 from the top. In some cases, the setting tool 150 may be a conventional explosive setting tool. The setting tool 150 can include a shear rod 170 and a setting sleeve 180.

Figure 3:
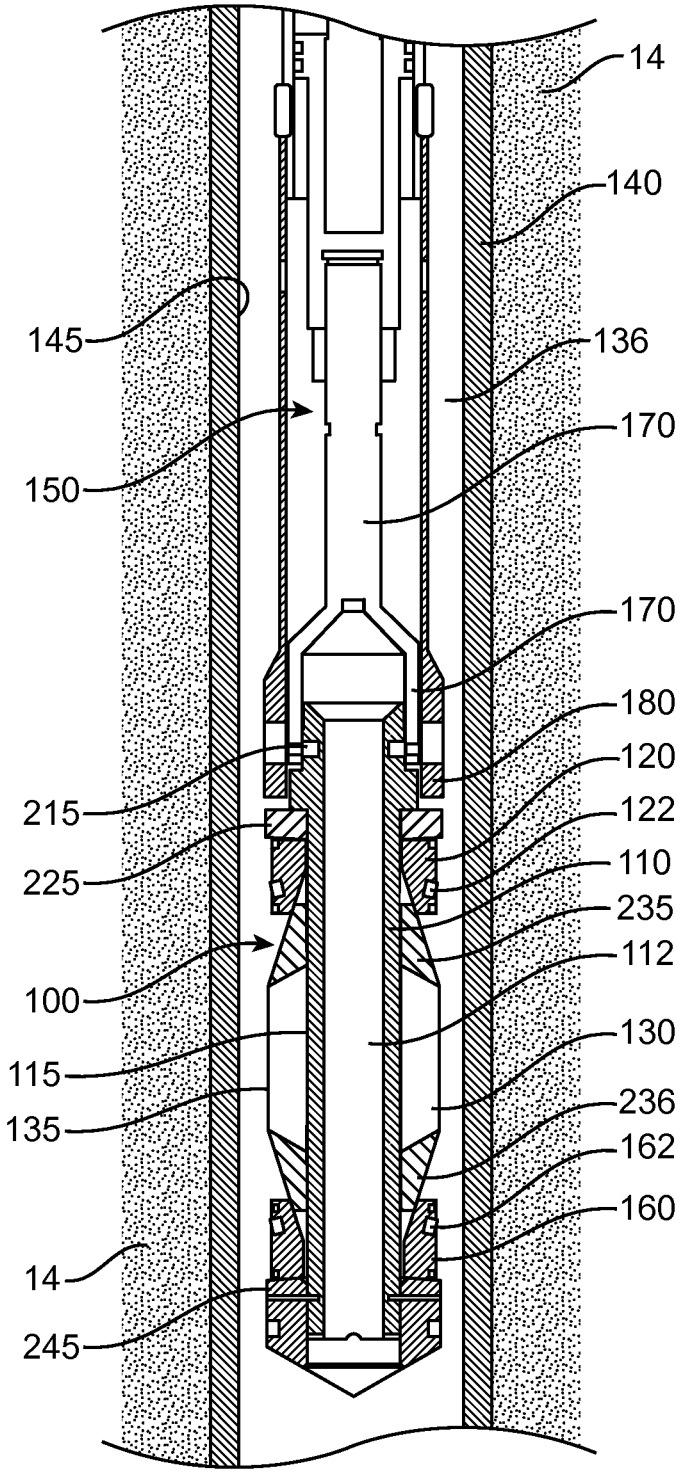
FIG. 3 is a close-up sectional view of a degradable wellbore isolation device coupled to a setting tool, according to an exemplary embodiment.

FIG. 3 depicts a close-up sectional view of the degradable wellbore isolation device 100 and the downhole portion of the setting tool 150. The degradable wellbore isolation device 100 is depicted in the un-set position suitable for running the degradable wellbore isolation device 100 in the wellbore 136 to a setting depth. As shown in FIG. 3, the shear rod 170 of the setting tool 150 is coupled with the tubular body 110 of the degradable wellbore isolation device 100 by shear pins disposed in shearing aperture 215. The degradable wellbore isolation device 100 includes a moveable abutment 225 at or near the first end (uphole end) of the tubular body 110. The moveable abutment 225 is slidably disposed about the external surface 115 of the tubular body 110 and serves to axially retain the substantially adjacent upper slip 120. The upper slip 120 is in turn substantially adjacent to the upper slip wedge 235. Button 122 is disposed on upper slip 120. The seal 130 is substantially adjacent to the upper slip wedge 235 and the lower slip wedge 236. The lower slip wedge 236 is substantially adjacent to the lower slip 160 which is substantially adjacent to the non-movable abutment 245 disposed on the tubular body 110 at or near the second end (downhole end) of the tubular body 110. Button 162 is disposed on the lower slip 160.

As the degradable wellbore isolation device 100 is lowered in the wellbore 136 to a setting depth, the setting sleeve 180 of the setting tool 150 is spaced apart from the moveable abutment 225 of the wellbore isolation device 100.

After the wellbore isolation device 100 is lowered in the wellbore 136 to the target location, the setting tool 150 is actuated to cause the degradable wellbore isolation device 100 to actuate from the un-set position to the set position. Actuation of the setting tool 150 causes the shear rod 170 to pull upwardly on the tubular body 110 while the setting sleeve 180 of the setting tool 150 engages the moveable abutment 225 of the degradable wellbore isolation device 100, thereby preventing the moveable abutment 225 from moving upwards with the tubular body 110. As a result, actuation of the setting tool 150 causes tension in the tubular body 110 while exerting a compressive force on the moveable abutment 225. The tension on the tubular body 110 and the compressive force exerted on the moveable abutment 225 exerts a downward force on the upper slip 120. As the upper slip 120 is compressed by the moveable abutment 225, the upper slip 120 slides relative to the upper slip wedge 235 causing the upper slip 120 to radially expand outward against the inner wall of the casing. Simultaneously, the radial expansion of the upper slip 120 forces the button 122 against the inner wall 145 of the casing 140. As the radial force is increased, the button 122 penetrates into the inner wall 145 of the casing 140. The radial force is sufficient to cause the button 122 to penetrate the casing grade for the particular casing 140 utilized. Casing grades are the industry standardized measures of casing-strength properties. Since most oilfield casing is of approximately the same chemistry (typically steel), and differs only in the heat treatment applied, the grading system provides for standardized strengths of casing to be manufactured and used in wellbores.

Further compressive force exerted on the seal 130 by upper slip wedge 235 causes the seal 130 to radially extend outwards to engage the inner wall 145 of the casing 140. Radial extension of the seal 130 further compresses the lower slip wedge 236 causing the lower slip wedge 236 to compress the lower slip 160 against the non-movable abutment 245. Compression of the lower slip 160 against the non-movable abutment 245 causes the lower slip 160 to radially extend outward against the inner wall 145 of the casing 140. Simultaneously, the radial expansion of the lower slip 160 forces the button 162 against the inner wall 145 of the casing 140. As the radial force is increased, the button 162 penetrates into the inner wall 145 of the casing 140. The radial force is sufficient to cause the button 162 to penetrate the casing grade for the particular casing 140 utilized.

Once the upper slip 120, lower slip 160, and the seal 130 have been sufficiently compressed to expand outwardly into sealing engagement with the inner surface 145 of casing 140, further tension on the tubular body 110 by the shear rod 170 of the setting tool 150 will shear the shear pins disposed in shearing apertures 215 thereby releasing the setting tool 150 from the wellbore isolation device 100 so that the setting tool 150 may be removed from the wellbore 136 leaving the degradable wellbore isolation device 100 set in the wellbore 136.

Figure 4:
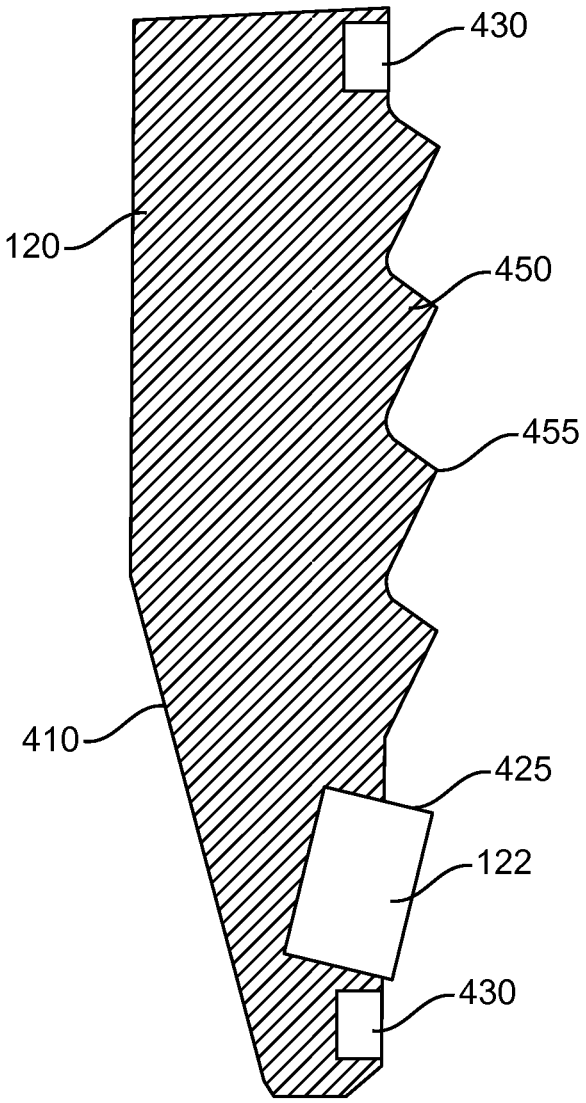
FIG. 4 is a close-up cross-sectional view of a slip having a plurality of wickers that can be included on a degradable wellbore isolation device, according to an exemplary embodiment.

FIG. 4 illustrates a cross-sectional view of an upper slip 120 having a plurality of wickers 450 and a frangible retaining ring 430. As shown, wickers 450 are integrally formed on upper slip 120. Wickers 450 define cutting edges 455, which securely engage the inner wall 145 of the casing 140, thereby setting the wellbore isolation device within the casing 140. Cutting edges 455 are the outermost edge of wickers 450 for engaging casing 140. Wickers 450 employing cutting edges 455 are positioned to deformably engage casing 140 by cutting into or penetrating casing 140. This action securely anchors the degradable wellbore isolation device 100 in the wellbore 136. Because of the large amount of pressure required to generate sufficient force for cutting edges 455 to deformably engage casing 140, button 122 provides for the initial anchoring of the degradable wellbore isolation device 100.

Button 122 is secured to the outer surface of the upper slip 120 and is positioned to engage the inner wall 145 of the casing 140. During the setting process, button 122 is forced against the inner wall 145 of the casing 140 due to the sliding of the slip surface 410 against a complementary surface on the upper slip wedge 235 causing the slip 120 to radially expand outward. The radial expansion of slip 120 causes the button edge 425 to engage the inner wall 145 of the casing 140. As the radial force increases, the button 122 penetrates the inner wall 145 of the casing 140.

While FIG. 4 illustrates an upper slip 120 as an exemplary embodiment, the lower slip 160 can also have one or more of the features shown in FIG. 4 without departing from the spirit and scope of the present disclosure, including, but not limited to, buttons 162, button edge 425, frangible retaining ring 430, wicker 450, cutting edge 455, and slip surface 410. Additionally, while FIGS. 2-5 illustrate exemplary slips, slips of any configuration can be used in the degradable wellbore isolation device 100 without departing from the spirit and scope of this disclosure. For instance, an upper slip 120 without a button 122 may be employed without departing from the spirit and scope of this disclosure. In some instances, the degradable wellbore isolation device 100 may include one or more slips characterized by a mechanical slip design. In other cases, the degradable wellbore isolation device 100 may include one or more slips characterized by a barrel slip design that provides full circumferential contact with the casing 140, thereby distributing tensile and compressive loads on the casing 140 without causing casing deformation. Barrel slips also ensure minimum slip tooth penetration into the casing wall by uniformly spreading the load across the circular cross-section of the casing 140.

In some cases, the buttons 122, 162 and the cutting edges 455 of the wickers 450 can collectively form an expandable two-stage downhole anchor for the degradable wellbore isolation device 100. In such cases, the buttons 122 define a first-stage anchor while the cutting edges 455 of wickers 450 define a second-stage anchor. Because button edges 425 and cutting edges 455 engage casing 140, each button 122, 162 and wicker 450 must have a hardness rating exceeding that of the casing 140.

In some cases, the cutting edges 455 of wickers 450 can engage the inner wall 145 of casing 140 at the same time that the buttons 122, 162 engage the inner wall 145 of the casing 140.

As shown in FIG. 4, frangible retaining rings 430 are disposed in grooves on the outer surface of upper slip 120. The frangible retaining rings 430 retain slip 120 in an unset position about the tubular body 110 when the degradable wellbore isolation device 100 is lowered into the wellbore 136. The frangible retaining rings 430 are configured to break as the upper slip 120 expands radially outward. However, the frangible retaining rings 430 have sufficient strength to prevent premature breakage. Frangible retaining rings 430 may be made of any material having adequate strength to prevent premature breakage.

Figure 5:
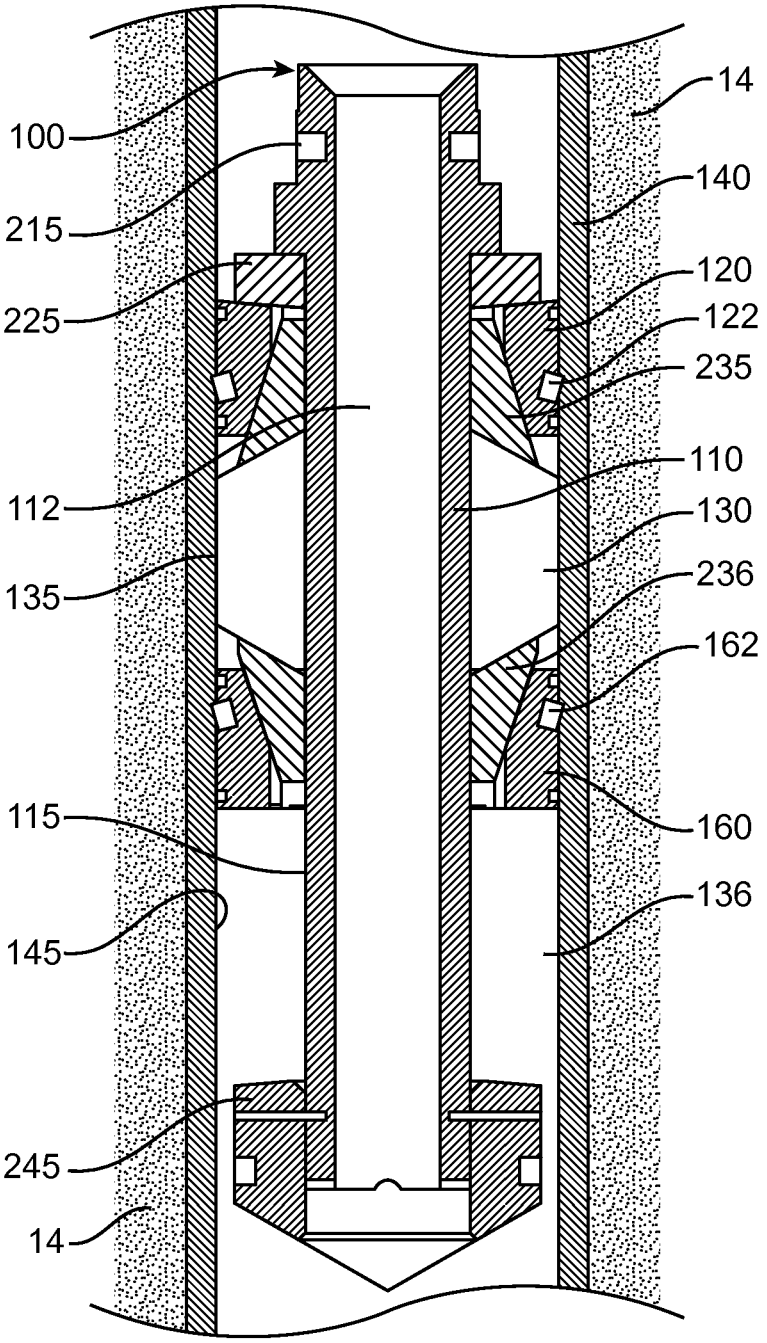
FIG. 5 is a sectional view of a degradable wellbore isolation device after having been set in a wellbore, according to an exemplary embodiment.

FIG. 5 illustrates a sectional view of a degradable wellbore isolation device 100 after having been set in a wellbore 136. As shown in FIG. 5, when the degradable wellbore isolation device 100 is in the set position, the upper slip 120, seal 130, and lower slip 160 have radially expanded and sealingly engaged the inner wall 145 of the casing 140. In addition, buttons 122 and 162, disposed on upper slip 120 and lower slip 160, respectively, have penetrated the inner wall 145 of casing 140 to anchor the wellbore isolation device 100 to the casing 140. In the set position, the wellbore isolation device 100 is retained in the wellbore 136 to provide zonal isolation in the wellbore 136 during subsequent downhole operations.

Degradable wellbore isolation devices of any design or configuration may be used without departing from the spirit and scope of the present disclosure, as long as the degradable wellbore isolation device 100 is comprised of a downhole degradable metal and is strong enough to be set from the top while effectively providing zonal isolation during downhole operations. In some cases, the downhole degradable metal exhibits an ultimate tensile strength of at least 20,000 psi. Although the exemplary embodiments of a degradable wellbore isolation device 100 shown in FIGS. 2-5 illustrate a frac plug, degradable wellbore isolation devices of other designs may be used. For instance, the degradable wellbore isolation device can also be a bridge plug, a packer, a ball plug, a wiper plug, a cement plug, a basepipe plug, a sand control plug, and any combination thereof.

The degradable wellbore isolation device 100 described herein includes one or more components comprised of a downhole degradable metal. For instance, the tubular body 110 can be comprised of a downhole degradable metal. In some instances, the degradable wellbore isolation device 100 can include multiple structural components that may each be comprised of a downhole degradable metal. For instance, a degradable wellbore isolation device 100 may include at least two components, each of which are comprised of a downhole degradable metal. In other instances, a degradable wellbore isolation device 100 may include more than two components that are each made of the downhole degradable metal.

It is not necessary that each component of the degradable wellbore isolation device 100 be composed of a downhole degradable metal, provided that the degradable wellbore isolation device 100 is capable of sufficient degradation for use in a particular downhole operation. It is also not necessary that the components of the degradable wellbore isolation device 100 be comprised of the same downhole degradable metal. For instance, two components of the degradable wellbore isolation device 100 may each be comprised of the same or different downhole degradable metals. Accordingly, one or more components of the degradable wellbore isolation device 100 may have varying degradation rates based on the type of downhole degradable metal selected. For example, some components of the degradable wellbore isolation device 100 may be made of a doped magnesium alloy having a delayed degradation rate compared to another component made of a different doped magnesium alloy to ensure that certain portions of the degradable wellbore isolation device 100 degrade prior to other portions.

The degradation rate of the downhole degradable metal can be anywhere from about 4 hours to about 120 days from first contact with the appropriate wellbore environment. In some instances, the degradation rate of the downhole degradable metal can be accelerated based on the conditions of the wellbore (either natural or introduced), including temperature, pH, and the like. In some instances, the downhole degradable metal can have a dissolution rate in excess of 0.01 $mg/cm^2/hr$ at 200° F. in 15% KCl. In some instances, a component of a degradable wellbore isolation device 100 comprised of a downhole degradable metal can lose greater than 0.1% of its total mass per day at 200° F. in 15% KCl.

The downhole degradable metal, described herein, can be a magnesium alloy. Magnesium alloys comprise at least one other element in addition to magnesium. The other elements can be selected from one or more metals, one or more non-metals, or a combination thereof. Suitable metals that may be alloyed with magnesium include, but are not limited to, lithium, sodium, potassium, rubidium, cesium, beryllium, calcium, strontium, barium, aluminum, gallium, indium, tin, thallium, lead, bismuth, scandium, titanium, vanadium, chromium, manganese, iron, cobalt, nickel, copper, zinc, yttrium, zirconium, niobium, molybdenum, ruthenium, rhodium, palladium, praseodymium, silver, lanthanum, hafnium, tantalum, tungsten, terbium, rhenium, osmium, iridium, platinum, gold, neodymium, gadolinium, erbium, oxides of any of the foregoing, and any combinations thereof.

Suitable non-metals that may be alloyed with magnesium include, but are not limited to, graphite, carbon, silicon, boron nitride, and combinations thereof. The carbon can be in the form of carbon particles, fibers, nanotubes, or fullerenes. The graphite can be in the form of particles, fibers, or graphene. The magnesium and its alloyed element(s) can be in a solid solution or in a partial solution or a compound where inter-granular inclusions may be present. In some cases, the magnesium and the alloyed element(s) may be uniformly distributed throughout the magnesium alloy, however, some minor variations in the distribution of particles of the magnesium and the alloyed element(s) can occur.

Suitable magnesium alloys include alloys having magnesium at a concentration in the range of about 70% to about 98% by volume of the metal alloy. In some cases, the downhole degradable metal can be a magnesium alloy having magnesium at a concentration in the range of about 80% to about 95% by volume of the metal alloy.

In some instances, the magnesium alloy can be selected from the group consisting of: 4.8% to 6.2% zinc, a minimum 0.45% zirconium, up to 0.3% impurities, and balance magnesium; 7.8% to 9.2% aluminum, 0.2% to 0.8% zinc, 0.12% manganese, up to 0.015% impurities, and balance magnesium; 2.5% to 3.5% aluminum, 0.7% to 1.3% zinc, 0.2% manganese, up to 0.15% impurities, and balance magnesium; and any combinations thereof.

Magnesium alloys are referred to by one skilled in the art and herein by short codes defined by the American Society for Testing and Materials ("ASTM") standard B275-13e1, which denotes approximate chemical compositions of the magnesium alloy by weight. Magnesium alloys may be doped or non-doped magnesium alloys. The doped magnesium alloys described herein exhibit a greater degradation rate compared to non-doped magnesium alloys owing to their specific composition, the presence of the dopant, the presence of inter-granular inclusions, or both. For example, the zinc concentration of a ZK (Z corresponding to zinc and and K corresponding to zirconium) magnesium alloy may vary from grain to grain within the alloy, which produces an inter-granular variation in the galvanic potential. As another example, the dopant in a doped AZ (A corresponding to aluminum and Z corresponding to zinc) magnesium alloy may lead to the formation of inter-granular inclusions where the inter-granular inclusions have a slightly different galvanic potential than the grains in the alloy. These variations in the galvanic potential may result in increased corrosion as depicted in FIG. 6.

Figure 6:
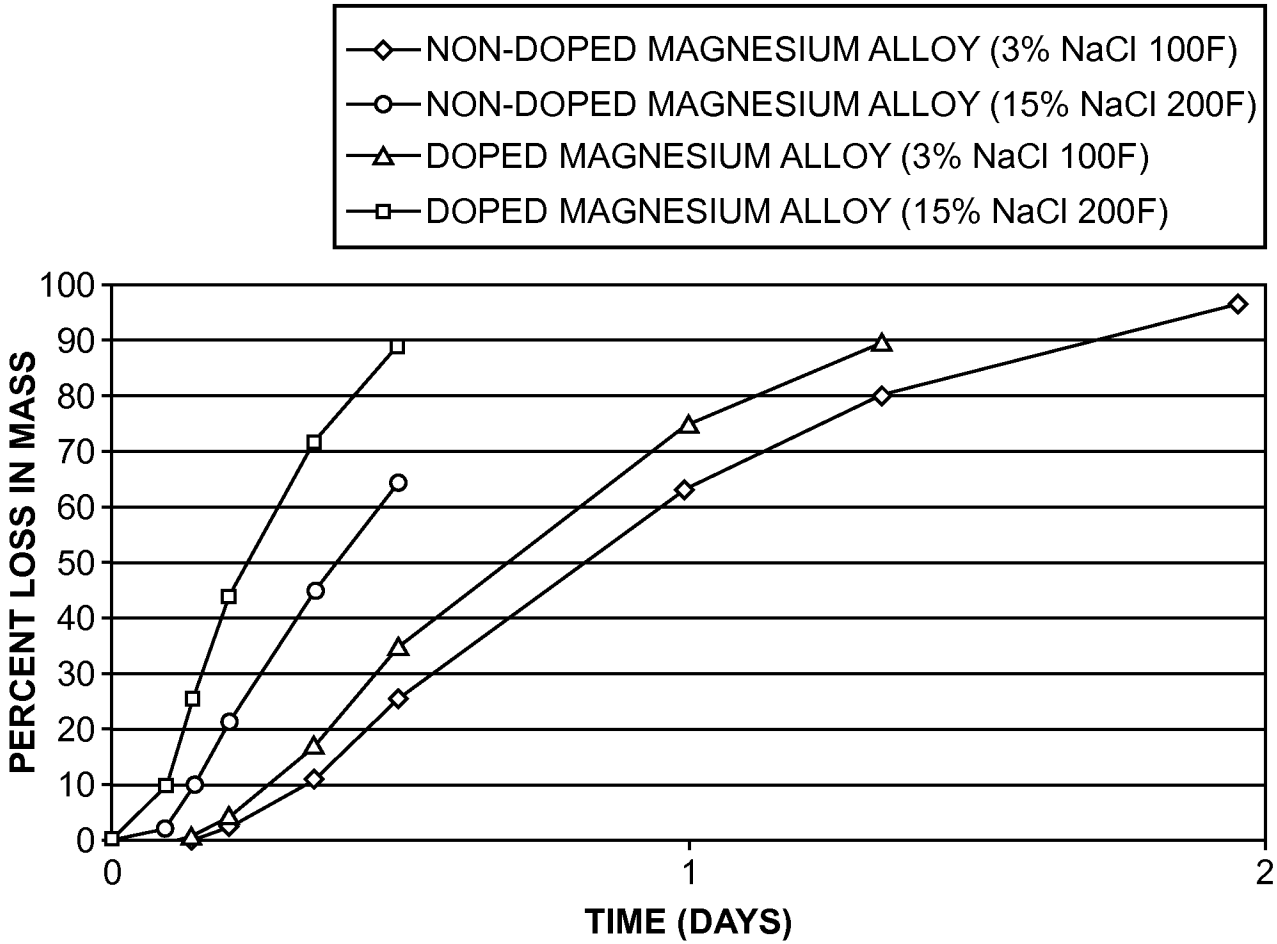
FIG. 6 illustrates the degradation rates of doped magnesium alloy solid solutions and non-doped magnesium alloy solid solutions, according to an exemplary embodiment.

FIG. 6 illustrates the degradation rates of doped magnesium alloy solid solutions and non-doped magnesium alloy solid solutions. More specifically, the data in FIG. 6 compares the degradation rate of a non-doped magnesium alloy to that of a doped magnesium alloy in two different electrolyte solutions. Each of the doped and non-doped magnesium alloys were placed in an electrolyte solution of 3% sodium chloride in fresh water and incubated at about 38° C. (100° F.), or placed in an electrolyte solution of 15% sodium chloride in fresh water and incubated at about 93° C. (200° F.) to determine dissolution (i.e., degradation) rate. The dissolution rate was measured by determining the percent loss in mass for each of the doped magnesium alloy and the non-doped magnesium alloy and were measured until mass measurements could no longer be attained. The non-doped magnesium alloy was composed of 90.5% magnesium with the remainder as aluminum, and zinc. The doped magnesium alloy was composed of 90.45% magnesium, with the remainder as aluminum, zinc, and an iron dopant.

As shown in FIG. 6, the rate of degradation of the doped magnesium alloy was faster than the non-doped magnesium alloy counterparts, in both conditions tested. For example, in the 3% electrolyte solution at about 38° C., after the elapse of about 24 hours, the non-doped magnesium alloy lost about 63% of its mass and the doped magnesium alloy lost about 75% of its mass. Similarly, after the elapse of about 32 hours (1.3 days), the non-doped magnesium alloy lost about 80% of its mass whereas the doped magnesium alloy lost about 90% of its mass. With respect to the 15% electrolyte solution at about 93° C., after the elapse of about 8 hours, the non-doped magnesium alloy lost about 45% of its mass and the doped magnesium alloy lost about 72% of its mass. Similarly, after the elapse of about 12 hours the non-doped magnesium alloy lost about 64% of its mass whereas the doped magnesium alloy lost about 89% of its mass.

The downhole degradable metal, described herein, can be a doped magnesium alloy. The doped magnesium alloy can be a doped WE magnesium alloy, a doped AZ magnesium alloy, a doped ZK magnesium alloy, a doped AM magnesium alloy, and any combination thereof.

Doped magnesium alloys may be in the form of a solid solution. As used herein, the term "solid solution" refers to an alloy that is formed from a single melt where all of the components in the alloy (e.g., a magnesium alloy) are melted together in a casting. The casting can be subsequently extruded, wrought, hipped, or worked. The magnesium and the at least one other ingredient are uniformly distributed throughout the magnesium alloy, although intra-granular inclusions may also be present, without departing from the spirit and scope of the present disclosure. In some cases, the magnesium and at least one other ingredient in the doped magnesium alloys described herein are in a solid solution, wherein the addition of a dopant results in intra-granular inclusions being formed.

The doped WE magnesium alloy can comprise between about 88% to about 95% of magnesium by weight of the doped WE (W corresponding to Yttrium and E corresponding to rare earth metals) magnesium alloy, between about 3% to about 5% of yttrium by weight of the doped WE magnesium alloy, between about 2% to about 5% of a rare earth metal, and about 0.05% to about 5% of dopant by weight of the doped WE magnesium alloy, wherein the rare earth metal is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

The doped AZ magnesium alloy may comprise between about 87% to about 97% of magnesium by weight of the doped AZ magnesium alloy, between about 3% to about 10% of aluminum by weight of the doped AZ magnesium alloy, between about 0.3% to about 3% of zinc by weight of the doped AZ magnesium alloy, and between about 0.05% to about 5% of dopant by weight of the doped AZ magnesium alloy.

The doped ZK magnesium alloy may comprise between about 88% to about 96% of magnesium by weight of the doped ZK magnesium alloy, between about 2% to about 7% of zinc by weight of the doped ZK magnesium alloy, between about 0.45% to about 3% of zirconium by weight of the doped ZK magnesium alloy, and between about 0.05% to about 5% of dopant by weight of the doped ZK magnesium alloy.

The doped AM (A corresponding to aluminum and M corresponding to manganese) magnesium alloy may comprise between about 87% to about 97% of magnesium by weight of the doped AM magnesium alloy, between about 2% to about 10% of aluminum by weight of the doped magnesium alloy, between about 0.3% to about 4% of manganese by weight of the doped AM magnesium alloy, and between about 0.05% to about 5% of dopant by weight of the doped AM magnesium alloy.

Suitable dopants for use in forming the doped magnesium alloys described herein may include, but are not limited to, iron, copper, nickel, tin, chromium, cobalt, calcium, lithium, silver, gold, palladium, and any combination thereof.

In some cases, the rate of degradation of the doped magnesium alloys described herein may be in the range of a lower limit of about 1%, 5%, 10%, 15%, 20%, 25%, 30%, 35%, 40%, 45%, and 50% to an upper of about 100%, 95%, 90%, 85%, 80%, 75%, 70%, 65%, 60%, 55%, and 50% of its total mass per about 24 hours in a 3% electrolyte solution (e.g., potassium chloride in an aqueous fluid) at about 93° C. (200° F.). In other cases, the dissolution rate of the doped magnesium alloy may be between a lower limit of about 1 $mg/cm^2$, 100 $mg/cm^2$, 200 $mg/cm^2$, 300 $mg/cm^2$, 400 $mg/cm^2$, 500 $mg/cm^2$, 600 $mg/cm^2$, 700 $mg/cm^2$, 800 $mg/cm^2$, 900 $mg/cm^2$, and 1000 $mg/cm^2$ to an upper limit of about 2000 $mg/cm^2$, 1900 $mg/cm^2$, 1800 $mg/cm^2$, 1700 $mg/cm^2$, 1600 $mg/cm^2$, 1500 $mg/cm^2$, 1400 $mg/cm^2$, 1300 $mg/cm^2$, 1200 $mg/cm^2$, 1100 $mg/cm^2$, and 1000 $mg/cm^2$ per about one hour in a 15% electrolyte solution (e.g., a halide salt, such as potassium chloride or sodium chloride, in an aqueous fluid) at about 93° C. (200° F.), encompassing any value and subset therebetween.

The downhole degradable metal, described herein, can be a non-doped magnesium alloy. The non-doped magnesium alloy can be a non-doped WE magnesium alloy, a non-doped AZ magnesium alloy, a non-doped ZK magnesium alloy, a non-doped AM magnesium alloy, and any combination thereof.

The non-doped WE magnesium alloy can comprise between about 88% to about 95% of magnesium by weight of the non-doped WE magnesium alloy, between about 3% to about 5% of yttrium by weight of the non-doped WE magnesium alloy, and between about 2% to about 5% of a rare earth metal, wherein the rare earth metal is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

The non-doped AZ magnesium alloy may comprise between about 87% to about 97% of magnesium by weight of the non-doped AZ magnesium alloy, between about 3% to about 10% of aluminum by weight of the non-doped AZ magnesium alloy, and between about 0.3% to about 3% of zinc by weight of the non-doped AZ magnesium alloy.

The non-doped ZK magnesium alloy may comprise between about 90% to about 98% of magnesium by weight of the non-doped ZK magnesium alloy, between about 2% to about 7% of zinc by weight of the non-doped ZK magnesium alloy, and between about 0% to about 3% of zirconium by weight of the non-doped ZK magnesium alloy.

The non-doped AM magnesium alloy may comprise between about 87% to about 97% of magnesium by weight of the non-doped AM magnesium alloy, between about 2% to about 10% of aluminum by weight of the non-doped magnesium alloy, and between about 0.3% to about 4% of manganese by weight of the non-doped AM magnesium alloy.

The downhole degradable metal, described herein, can be an aluminum alloy. Aluminum alloys comprise at least one other element in addition to aluminum. The other elements can be selected from one or more metals, one or more non-metals, or a combination thereof. Suitable metals that may be alloyed with aluminum include, but are not limited to, magnesium (Mg), zinc (Zn), silicon (Si), gallium (Ga), mercury (Hg), indium (In), bismuth (Bi), tin (Sn), lead (Pb), antimony (Sb), and thallium (Tl), carbon (C) and any combinations thereof. In some instances, the aluminum alloy can comprise between about 0.5% to about 8.0% of gallium by weight of the aluminum alloy, between about 0.5% to about 8.0% of magnesium by weight of the aluminum alloy, and between about 0.1% to about 2.1% of indium by weight of the aluminum alloy. In other cases, the aluminum alloy can comprise between about 1.0% to about 6.0% of gallium by weight of the aluminum alloy, between about 2.0% to about 6.0% of magnesium by weight of the aluminum alloy, between about 0.1% to about 1.0% indium by weight of the aluminum alloy, and between about 0.1% to about 4.5% of zinc by weight of the aluminum alloy. In some instances, the aluminum alloy can comprise about 80% aluminum by weight of the aluminum alloy, about 10% of gallium by weight of the aluminum alloy, and about 10% of magnesium by weight of the aluminum alloy. In other instances, the aluminum alloy can comprise about 85% of aluminum by weight of the aluminum alloy, about 5% of gallium by weight of the aluminum alloy, about 5% of magnesium by weight of the aluminum alloy, and about 5% of indium by weight of the aluminum alloy.

In some cases, the downhole degradable metal forming at least a portion of the degradable wellbore isolation device 100 may be at least partially encapsulated in a second material (e.g., a "sheath") formed from an encapsulating material capable of protecting or prolonging degradation of the downhole degradable metal (e.g., delaying contact with an electrolyte). The sheath may also serve to protect the degradable wellbore isolation device 100 from abrasion within the wellbore 136. The structure of the sheath may be permeable, frangible, or of a material that is at least partially removable at a desire rate in the wellbore environment. The encapsulating material forming the sheath may be any material capable of use in a downhole environment, depending on the structure of the sheath. For example, a frangible sheath may break as the degradable wellbore isolation device 100 is placed at a desired location in the wellbore 136 or as the degradable wellbore isolation device is actuated, if applicable, whereas a permeable sheath may remain in place on the seal as it forms the fluid seal. As used herein, the term "permeable" refers to a structure that permits fluids (including liquids and gases) therethrough and is not limited to any particular configuration. Suitable encapsulating materials may include, but are not limited to, a TEFLON® coating, a wax, a drying oil, a polyurethane, an epoxy, a crosslinked partially hydrolyzed polyacrylic, a silicate material, a glass material, an inorganic durable material, a polymer, a polylactic acid, a polyvinyl alcohol, a polyvinylidene chloride, a hydrophobic coating, an anodized coating, an oxide coating, a paint, an elastomer, a thermoplastic, and any combination thereof.

In some cases, all or a portion of the outer surface of a given component of the degradable wellbore isolation device 100 may be treated to impede degradation. For example, the outer surface of a given component may undergo a treatment that aids in preventing the degradable material (e.g., a galvanically-corrodible metal) from galvanically-corroding. Suitable treatments include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the outer surface of a given component. The anodized layer may comprise materials such as, but not limited to, ceramics, metals, polymers, epoxies, elastomers, or any combination thereof and may be applied using any suitable processes known in the art. Examples of suitable processes that result in an anodized layer include, but are not limited to, soft anodized coating, anodized coating, electroless nickel plating, hard anodized coating, ceramic coatings, carbide beads coating, plastic coating, thermal spray coating, high velocity oxygen fuel (HVOF) coating, a nano HVOF coatings, and a metallic coating.

In some cases, all or a portion of the outer surface of a given component of the degradable wellbore isolation device 100 may be treated or coated with a substance configured to enhance degradation of the degradable material. For example, such a treatment or coating may be configured to remove a protective coating or treatment or otherwise accelerate the degradation of the degradable material of the given component. An example is a downhole degradable metal coated with a layer of polyglycolic acid (PGA). In this example, the PGA would undergo hydrolysis and cause the surrounding fluid to become more acidic, which would accelerate the degradation of the underlying metal.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or equivalently, "from approximately a to b," or, equivalently, "from approximately a-b") disclosed herein is to be understood to set forth every number and range encompassed within the broader range of values. Moreover, the indefinite articles "a" or "an," as used in the claims, are defined herein to mean one or more than one of the element that it introduces.

As disclosed herein, a method for providing zonal isolation in a wellbore is provided. The method includes running a wellbore isolation device into a wellbore to a setting depth, where the wellbore isolation device includes a tubular body, a slip disposed about the external surface of the tubular body, and a seal disposed about the external surface of the tubular body, wherein the tubular body is at least partly composed of a downhole degradable metal. The tubular body further has an external surface defining an inner bore. Additionally, the tubular body has a first end and a second end with the first end to be oriented in the uphole direction of the wellbore. The slip has a radially extendible surface and the seal has a radially extendible elastomeric sealing surface. The method further includes, responsive to tension applied to the tubular body, the slip and the seal radially extend, thereby setting the wellbore isolation device within the wellbore.

The method can further include performing a wellbore operation and degrading at least a portion of the tubular body by contacting the tubular body with an aqueous solution in the wellbore. The method can further include a wellbore isolation device that includes a tubular body composed of a magnesium alloy or an aluminum alloy as the downhole degradable metal. In some cases, the downhole degradable metal comprising the tubular body can also be selected from the group consisting of a doped WE magnesium alloy, a doped AZ magnesium alloy, a doped ZK magnesium alloy, a doped AM magnesium alloy, and any combination thereof. In some cases, the downhole degradable metal can also have an ultimate tensile strength of at least 20,000 psi.

As disclosed herein, a system for providing zonal isolation in a wellbore is provided. The system includes a wellbore and a wellbore isolation device including a tubular body comprising an external surface and an inner bore formed therein, wherein the tubular body has a first end and a second end, the first end to be oriented in the uphole direction of the wellbore, a slip disposed about the external surface of the tubular body, wherein the slip has a radially extendible surface, and a seal disposed about the external surface of the tubular body, wherein the seal has a radially extendible elastomeric sealing surface, wherein the slip and the seal radially extend responsive to tension applied to the tubular body and wherein the tubular body comprises a downhole degradable metal that at least partially degrades when exposed to a wellbore environment.

The system can further include a setting tool including a shear rod removably coupled with the tubular body of the wellbore isolation device and a setting sleeve configured to engage the moveable abutment or the slip of the wellbore isolation device, wherein the shear rod is configured to apply tension to the tubular body, thereby setting the wellbore isolation device in the wellbore.

Statements of the Disclosure Include:

Statement 1: A wellbore isolation device comprising: a tubular body comprising an external surface and an inner bore formed therein, wherein the tubular body has a first end and a second end, the first end to be oriented in the uphole direction of the wellbore; a slip disposed about the external surface of the tubular body, wherein the slip has a radially extendible surface; and a seal disposed about the external surface of the tubular body, wherein the seal has a radially extendible elastomeric sealing surface; wherein the slip and the seal radially extend responsive to tension applied to the tubular body; and wherein the tubular body comprises a downhole degradable metal that at least partially degrades when exposed to a wellbore environment.

Statement 2: A wellbore isolation device according to Statement 1, wherein the downhole degradable metal is a magnesium alloy.

Statement 3: A wellbore isolation device according to Statement 1 or Statement 2, wherein the downhole degradable metal is a magnesium alloy selected from the group consisting of: 4.8% to 6.2% zinc, a minimum 0.45% zirconium, up to 0.3% impurities, and balance magnesium; 7.8% to 9.2% aluminum, 0.2% to 0.8% zinc, 0.12% manganese, up to 0.015% impurities, and balance magnesium; 2.5% to 3.5% aluminum, 0.7% to 1.3% zinc, 0.2% manganese, up to 0.15% impurities, and balance magnesium; and any combinations thereof.

Statement 4: A wellbore isolation device according to Statement 1 or Statement 2, wherein the downhole degradable metal is a doped magnesium alloy.

Statement 5: A wellbore isolation device according to any one of the preceding Statements 1-2 or 4, wherein the downhole degradable metal is selected from the group consisting of a doped WE magnesium alloy, a doped AZ magnesium alloy, a doped ZK magnesium alloy, a doped AM magnesium alloy, and any combination thereof.

Statement 6: A wellbore isolation device according to Statement 5, wherein the doped WE magnesium alloy comprises between about 88% to about 95% of magnesium by weight of the doped WE magnesium alloy, between about 3% to about 5% of yttrium by weight of the doped WE magnesium alloy, between about 2% to about 5% of a rare earth metal, and about 0.05% to about 5% of dopant by weight of the doped WE magnesium alloy; wherein the rare earth metal is selected from the group consisting of scandium, lanthanum, cerium, praseodymium, neodymium, promethium, samarium, europium, gadolinium, dysprosium, holmium, erbium, thulium, ytterbium, lutetium, and any combination thereof; and wherein the dopant is selected from the group consisting of iron, copper, nickel, tin, chromium, cobalt, calcium, lithium, silver, gold, palladium, and any combination thereof.

Statement 7: A wellbore isolation device according to Statement 5, wherein the doped AZ magnesium alloy comprises between about 87% to about 97% of magnesium by weight of the doped AZ magnesium alloy, between about 3% to about 10% of aluminum by weight of the doped AZ magnesium alloy, between about 0.3% to about 3% of zinc by weight of the doped AZ magnesium alloy, and between about 0.05% to about 5% of dopant by weight of the doped AZ magnesium alloy; and wherein the dopant is selected from the group consisting of iron, copper, nickel, tin, chromium, cobalt, calcium, lithium, silver, gold, palladium, and any combination thereof.

Statement 8: A wellbore isolation device according to Statement 5, wherein the doped ZK magnesium alloy comprises between about 88% to about 96% of magnesium by weight of the doped ZK magnesium alloy, between about 2% to about 7% of zinc by weight of the doped ZK magnesium alloy, between about 0.45% to about 3% of zirconium by weight of the doped ZK magnesium alloy, and between about 0.05% to about 5% of dopant by weight of the doped ZK magnesium alloy; and wherein the dopant is selected from the group consisting of iron, copper, nickel, tin, chromium, cobalt, calcium, lithium, silver, gold, palladium, and any combination thereof.

Statement 9: A wellbore isolation device according to Statement 5, wherein the doped AM magnesium alloy comprises between about 87% to about 97% of magnesium by weight of the doped AM magnesium alloy, between about 2% to about 10% of aluminum by weight of the doped magnesium alloy, between about 0.3% to about 4% of manganese by weight of the doped AM magnesium alloy, and between about 0.05% and 5% of dopant by weight of the doped AM magnesium alloy; and wherein the dopant is selected from the group consisting of iron, copper, nickel, tin, chromium, cobalt, calcium, lithium, silver, gold, palladium, and any combination thereof.

Statement 10: A wellbore isolation device according to Statement 1 or Statement 2,wherein the downhole degradable metal is a non-doped magnesium alloy.

Statement 11: A wellbore isolation device according to any one of the preceding Statements 1-2, and 10, wherein the downhole degradable metal is selected from the group consisting of a non-doped WE magnesium alloy, a non-doped AZ magnesium alloy, a non-doped ZK magnesium alloy, a non-doped AM magnesium alloy, and any combination thereof.

Statement 12: A wellbore isolation device according to Statement 11, wherein the non-doped WE magnesium alloy comprises between about 88% to about 95% of magnesium by weight of the non-doped WE magnesium alloy, between about 3% to about 5% of yttrium by weight of the non-doped WE magnesium alloy, and between about 2% to about 5% of a rare earth metal, wherein the rare earth metal is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

Statement 13: A wellbore isolation device according to Statement 11, wherein the non-doped AZ magnesium alloy comprises between about 87% to about 97% of magnesium by weight of the non-doped AZ magnesium alloy, between about 3% to about 10% of aluminum by weight of the non-doped AZ magnesium alloy, and between about 0.3% to about 3% of zinc by weight of the non-doped AZ magnesium alloy.

Statement 14: A wellbore isolation device according to Statement 11, wherein the non-doped ZK magnesium alloy comprises between about 90% to about 98% of magnesium by weight of the non-doped ZK magnesium alloy, between about 2% to about 7% of zinc by weight of the non-doped ZK magnesium alloy, and between about 0% to about 3% of zirconium by weight of the non-doped ZK magnesium alloy.

Statement 15: A wellbore isolation device according to Statement 11, wherein the non-doped AM magnesium alloy comprises between about 87% to about 97% of magnesium by weight of the non-doped AM magnesium alloy, between about 2% to about 10% of aluminum by weight of the non-doped magnesium alloy, and between about 0.3% to about 4% of manganese by weight of the non-doped AM magnesium alloy.

Statement 16: A wellbore isolation device according to Statement 1, wherein the downhole degradable metal comprises an aluminum alloy.

Statement 17: A wellbore isolation device according to Statement 16, wherein the aluminum alloy comprises between about 0.5% to about 8.0% of gallium by weight of the aluminum alloy, between about 0.5% to about 8.0% of magnesium by weight of the aluminum alloy, and between about 0.1% to about 2.1% of indium by weight of the aluminum alloy.

Statement 18: A wellbore isolation device according to Statement 16, wherein the aluminum alloy comprises between about 1.0% to about 6.0% of gallium by weight of the aluminum alloy, between about 2.0% to about 6.0% of magnesium by weight of the aluminum alloy, between about 0.1% to about 1.0% indium by weight of the aluminum alloy, and between about 0.1% to about 4.5% of zinc by weight of the aluminum alloy.

Statement 19: A wellbore isolation device according to Statement 16, wherein the aluminum alloy comprises about 80% aluminum by weight of the aluminum alloy, about 10% of gallium by weight of the aluminum alloy, and about 10% of magnesium by weight of the aluminum alloy.

Statement 20: A wellbore isolation device according to Statement 16, wherein the aluminum alloy comprises about 85% of aluminum by weight of the aluminum alloy, about 5% of gallium by weight of the aluminum alloy, about 5% of magnesium by weight of the aluminum alloy, and about 5% of indium by weight of the aluminum alloy.

Statement 21: A wellbore isolation device according to any one of the preceding Statements 1-20, wherein the downhole degradable metal exhibits a dissolution rate in excess of 0.01 $mg/cm^2/hr$ at 200° F. in 15% KCl.

Statement 22: A wellbore isolation device according to any one of the preceding Statements 1-20, wherein the downhole degradable metal exhibits a degradation rate of at least 0.01 $mg/cm^2$ per hour in a 15% potassium chloride aqueous solution and at a temperature of about 93° C.

Statement 23: A wellbore isolation device according to any one of the preceding Statements 1-20, wherein a component of the wellbore isolation device exhibits a loss of greater than 0.1% of its total mass per day at 200° F. in 15% KCl.

Statement 24: A wellbore isolation device according to any one of the preceding Statements 1-20, wherein the tubular body is degradable such that it loses at least 0.1% of the total mass of the tubular body per day in a 15% potassium chloride aqueous solution and at a temperature of about 93° C.

Statement 25: A wellbore isolation device according to any one of the preceding Statements 1-24, wherein the wellbore environment comprises an aqueous solution containing electrolytes at a temperature of at least 65° C.

Statement 26: A wellbore isolation device according to any one of the preceding Statements 1-25, wherein the downhole degradable metal exhibits an ultimate tensile strength of at least 20,000 psi.

Statement 27: A wellbore isolation device according to any one of the preceding Statements 1-26, wherein the tubular body has an inner diameter and an outer diameter, the inner diameter being at least 25% of the outer diameter.

Statement 28: A wellbore isolation device according to any one of the preceding Statements 1-27, wherein the extendible elastomeric sealing surface degrades when exposed to a wellbore environment.

Statement 29: A wellbore isolation device according to Statement 28, wherein the extendible elastomeric sealing surface is comprised of a polyurethane rubber, a polyester-based polyurethane rubber, a blend of chlorobutadiene rubber, reactive clay, and crosslinked sodium polyacrylate, a cellulose-based rubber (e.g., carboxy methyl cellulose), an acrylate-based polymer, a polyethylene glycol-based hydrogel, a silicone-based hydrogel, a polyacrylamide-based hydrogel, a polymacon-based hydrogel, a hyaluronic acid rubber, a polyhydroxobutyrate rubber, a polyester elastomer, a polyester amide elastomer, a polyamide elastomer, and any copolymers or terpolymers thereof, as well as any combination thereof.

Statement 30: A wellbore isolation device according to Statement 29, wherein the extendible elastomeric sealing surface is comprised of a copolymer or a terpolymer selected from the group consisting of a cellulose-based rubber and an acrylate rubber copolymer, a cellulose-based rubber, an acrylate rubber, and an acrylonitrile butadiene rubber terpolymer, an acrylate rubber and an acrylonitrile butadiene rubber copolymer, a cellulose-based rubber and an acrylonitrile butadiene rubber copolymer, and any combination thereof.

Statement 31: A wellbore isolation device according to any one of the preceding Statements 1-30, wherein the first end of the tubular body is coupled with a top setting tool.

Statement 32: A wellbore isolation device according to any one of the preceding Statements 1-31, wherein the first end of the tubular body has a shearing aperture for receiving a shear pin.

Statement 33: A wellbore isolation device according to any one of the preceding Statements 1-32, further comprising a moveable abutment disposed on the tubular body on one side of the seal, at or near the first end of the tubular body, and a non-movable abutment disposed on the tubular body on the opposite side of the seal, at or near the second end of the tubular body.

Statement 34: A wellbore isolation device according to Statement 33, wherein responsive to tension on the tubular body, the movable abutment moves toward the non-movable abutment thereby causing the extendible surface of the slip and the extendible elastomeric sealing surface of the seal to radially extend.

Statement 35: A wellbore isolation device according to any one of the preceding Statements 1-34, wherein the wellbore isolation device is selected from the group consisting of a frac plug, a bridge plug, a packer, a ball plug, a wiper plug, a cement plug, a basepipe plug, a sand control plug, and any combination thereof.

Statement 36: A wellbore isolation device according to any one of the preceding Statements 1-35, wherein the wellbore isolation device further comprises one or more components made of a downhole degradable metal selected from the group consisting of the tubular body or mandrel of a packer or a plug, a slip, a seal, a sealing element, a wedge, a spacer ring, a retainer ring, a ball, a ball seat, a flapper, a housing, a flow control device or plug, an extrusion limiter or backup shoe, a mule shoe, or any other wellbore isolation device component thereof.

Statement 37: A wellbore isolation device according to any one of the preceding Statements 1-36, wherein the downhole degradable metal degrades upon exposure to an electrolyte fluid introduced into the wellbore environment.

Statement 38: A wellbore isolation device according to any one of the preceding Statements 1-37, wherein the wellbore isolation device is further comprised of two or more downhole degradable metals that exhibit different degradation rates in the wellbore environment.

Statement 39: A wellbore isolation device according to any one of the preceding Statements 1-38, wherein the tubular body comprises a mandrel.

Statement 40: A wellbore isolation device according to any one of the preceding Statements 1-39, wherein the degradation rate of the downhole degradable metal is in the range of a lower limit of about 1%, 5%, 10%, 15%, 20%, 25%, 30%, 35%, 40%, 45%, and 50% to an upper of about 100%, 95%, 90%, 85%, 80%, 75%, 70%, 65%, 60%, 55%, and 50% of its total mass per about 24 hours in a 3% electrolyte solution (e.g., potassium chloride in an aqueous fluid) at about 93° C. (200° F.).

Statement 41: A wellbore isolation device according to any one of the preceding Statements 1-39, wherein the dissolution rate of the downhole degradable metal is between a lower limit of about 1 $mg/cm^2$, 100 $mg/cm^2$, 200 $mg/cm^2$, 300 $mg/cm^2$, 400 $mg/cm^2$, 500 $mg/cm^2$, 600 $mg/cm^2$, 700 $mg/cm^2$, 800 $mg/cm^2$, 900 $mg/cm^2$, and 1000 $mg/cm^2$ to an upper limit of about 2000 $mg/cm^2$, 1900 $mg/cm^2$, 1800 $mg/cm^2$, 1700 $mg/cm^2$, 1600 $mg/cm^2$, 1500 $mg/cm^2$, 1400 $mg/cm^2$, 1300 $mg/cm^2$, 1200 $mg/cm^2$, 1100 $mg/cm^2$, and 1000 $mg/cm^2$ per about one hour in a 15% electrolyte solution (e.g., a halide salt, such as potassium chloride or sodium chloride, in an aqueous fluid) at about 93° C. (200° F.), encompassing any value and subset therebetween.

Statement 42: A wellbore isolation device according to any one of the preceding Statements 1-41, wherein the wellbore isolation device further comprises a protective sheath.

Statement 43: A wellbore isolation device according to Statement 42, wherein the protective sheath comprises a material selected from the group consisting of a TEFLON® coating, a wax, a drying oil, a polyurethane, an epoxy, a crosslinked partially hydrolyzed polyacrylic, a silicate material, a glass material, an inorganic durable material, a polymer, a polylactic acid, a polyvinyl alcohol, a polyvinylidene chloride, a hydrophobic coating, an anodized coating, an oxide coating, a paint, an elastomer, a thermoplastic, and any combination thereof.

Statement 44: A wellbore isolation device according to any one of the preceding Statements 1-43, wherein the wellbore isolation device further comprises a coating configured to enhance degradation of the downhole degradable metal.

Statement 45: A method comprising running a wellbore isolation device, according to any one of the preceding Statements 1-44, into a wellbore to a setting depth and responsive to tension applied to the tubular body, the slip and the seal radially extend, thereby setting the wellbore isolation device within the wellbore.

Statement 46: The method according to Statement 45, further comprising performing a wellbore operation and degrading at least a portion of the tubular body by contacting the tubular body with an aqueous solution in the wellbore.

Statement 47: The method according to Statement 45 or Statement 46, further comprising introducing an electrolyte solution into the wellbore for the purpose of causing or enhancing the degradation of the downhole degradable metal.

Statement 48: A method comprising running a wellbore isolation device into a wellbore to a setting depth, wherein the wellbore isolation device comprises: a tubular body comprising an external surface and an inner bore formed therein, wherein the tubular body has a first end and a second end, the first end to be oriented in the uphole direction of the wellbore; a slip disposed about the external surface of the tubular body, wherein the slip has a radially extendible surface; and a seal disposed about the external surface of the tubular body, wherein the seal has a radially extendible elastomeric sealing surface; wherein the tubular body comprises a downhole degradable metal; and responsive to tension applied to the tubular body, the slip and the seal radially extend, thereby setting the wellbore isolation device within the wellbore.

Statement 49: The method according to Statement 48, further comprising performing a wellbore operation and degrading at least a portion of the tubular body by contacting the tubular body with an aqueous solution in the wellbore.

Statement 50: The method according to Statement 48 or Statement 49, further comprising introducing an electrolyte solution into the wellbore for the purpose of causing or enhancing the degradation of the downhole degradable metal.

Statement 51: The method according to any one of preceding Statements 48-50, wherein the downhole degradable metal is a magnesium alloy or an aluminum alloy.

Statement 52: The method according to any one of preceding Statements 48-51, wherein the downhole degradable metal is selected from the group consisting of a doped WE magnesium alloy, a doped AZ magnesium alloy, a doped ZK magnesium alloy, a doped AM magnesium alloy, and any combination thereof.

Statement 53: The method according to any one of the preceding Statements 48-52, wherein the downhole degradable metal has an ultimate tensile strength of at least 20,000 psi.

Statement 54: A system comprising a wellbore and a wellbore isolation device according to any one of preceding Statements 1-44.

Statement 55: The system according to Statement 54, further comprising a setting tool comprising a shear rod removably coupled with the tubular body of the wellbore isolation device; and a setting sleeve configured to engage the moveable abutment or the slip of the wellbore isolation device, wherein the shear rod is configured to apply tension to the tubular body, thereby setting the wellbore isolation device in the wellbore.

Statement 56: A system comprising a wellbore; and a wellbore isolation device comprising: a tubular body comprising an external surface and an inner bore formed therein, wherein the tubular body has a first end and a second end, the first end to be oriented in the uphole direction of the wellbore; a slip disposed about the external surface of the tubular body, wherein the slip has a radially extendible surface; and a seal disposed about the external surface of the tubular body, wherein the seal has a radially extendible elastomeric sealing surface; wherein the slip and the seal radially extend responsive to tension applied to the tubular body; and wherein the tubular body comprises a downhole degradable metal that at least partially degrades when exposed to a wellbore environment.

Statement 57: The system according to Statement 56, further comprising a setting tool comprising: a shear rod removably coupled with the tubular body of the wellbore isolation device; and a setting sleeve configured to engage the moveable abutment or the slip of the wellbore isolation device, wherein the shear rod is configured to apply tension to the tubular body, thereby setting the wellbore isolation device in the wellbore.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

We claim:

1. A wellbore isolation device comprising:

a tubular body comprising an external surface and an inner bore formed therein, wherein the tubular body has a first end and a second end, the first end to be oriented in the uphole direction of the wellbore;

a slip disposed about the external surface of the tubular body, wherein the slip has a radially extendible surface; and a seal disposed about the external surface of the tubular body, wherein the seal has a radially extendible elastomeric sealing surface; and a moveable abutment disposed on the tubular body on one side of the seal, at or near the first end of the tubular body, and a non-movable abutment disposed on the tubular body on the opposite side of the seal, at or near the second end of the tubular body;

wherein the slip and the seal radially extend responsive to tension applied to the tubular body;

wherein the wellbore isolation device is capable of being set from the top responsive to tension applied to the tubular body; and wherein the tubular body comprises a downhole degradable metal that at least partially degrades when exposed to a wellbore environment, wherein the downhole degradable metal is a doped magnesium alloy comprising from about 87% to about 97% by weight magnesium of the doped magnesium alloy and from about 0.05% to about 5% by weight dopant of the doped magnesium alloy, and wherein the downhole degradable metal is strong enough to be set from the top, and wherein the doped magnesium alloy is selected from the group consisting of a doped WE magnesium alloy, a doped AZ magnesium alloy, a doped ZK magnesium alloy, a doped AM magnesium alloy, and any combination thereof.

2. The wellbore isolation device of claim 1, wherein the doped magnesium alloy is a doped WE magnesium alloy comprising between about 88% to about 95% of magnesium by weight of the doped WE magnesium alloy, between about 3% to about 5% of yttrium by weight of the doped WE magnesium alloy, between about 2% to about 5% of a rare earth metal, and about 0.05% to about 5% of dopant by weight of the doped WE magnesium alloy;

wherein the rare earth metal is selected from the group consisting of scandium, lanthanum, cerium, praseodymium, neodymium, promethium, samarium, europium, gadolinium, dysprosium, holmium, erbium, thulium, ytterbium, lutetium, and any combination thereof; and wherein the dopant is selected from the group consisting of iron, copper, nickel, tin, chromium, cobalt, calcium, lithium, silver, gold, palladium, and any combination thereof.

3. The wellbore isolation device of claim 1, wherein the doped magnesium alloy is a doped AZ magnesium alloy comprising between about 87% to about 97% of magnesium by weight of the doped AZ magnesium alloy, between about 3% to about 10% of aluminum by weight of the doped AZ magnesium alloy, between about 0.3% to about 3% of zinc by weight of the doped AZ magnesium alloy, and between about 0.05% to about 5% of dopant by weight of the doped AZ magnesium alloy; and wherein the dopant is selected from the group consisting of iron, copper, nickel, tin, chromium, cobalt, calcium, lithium, silver, gold, palladium, and any combination thereof.

4. The wellbore isolation device of claim 1, wherein the doped magnesium alloy is a doped ZK magnesium alloy comprising between about 88% to about 96% of magnesium by weight of the doped ZK magnesium alloy, between about 2% to about 7% of zinc by weight of the doped ZK magnesium alloy, between about 0.45% to about 3% of zirconium by weight of the doped ZK magnesium alloy, and between about 0.05% to about 5% of dopant by weight of the doped ZK magnesium alloy; and wherein the dopant is selected from the group consisting of iron, copper, nickel, tin, chromium, cobalt, calcium, lithium, silver, gold, palladium, and any combination thereof.

5. The wellbore isolation device of claim 1, wherein the doped magnesium alloy is a doped AM magnesium alloy comprising between about 87% to about 97% of magnesium by weight of the doped AM magnesium alloy, between about 2% to about 10% of aluminum by weight of the doped magnesium alloy, between about 0.3% to about 4% of manganese by weight of the doped AM magnesium alloy, and between about 0.05% and 5% of dopant by weight of the doped AM magnesium alloy; and wherein the dopant is selected from the group consisting of iron, copper, nickel, tin, chromium, cobalt, calcium, lithium, silver, gold, palladium, and any combination thereof.

6. The wellbore isolation device of claim 1, wherein the first end of the tubular body has a shearing aperture for receiving a shear pin.

7. The wellbore isolation device of claim 1, wherein responsive to tension on the tubular body, the movable abutment moves toward the non-movable abutment thereby causing the extendible surface of the slip and the extendible elastomeric sealing surface of the seal to radially extend.

8. The wellbore isolation device of claim 1, wherein the extendible elastomeric sealing surface degrades when exposed to a wellbore environment.

9. A method comprising:

running a top set wellbore isolation device into a wellbore to a setting depth, wherein the wellbore isolation device comprises:

a tubular body comprising an external surface and an inner bore formed therein, wherein the tubular body has a first end and a second end, the first end to be oriented in the uphole direction of the wellbore;

a slip disposed about the external surface of the tubular body, wherein the slip has a radially extendible surface; and a seal disposed about the external surface of the tubular body, wherein the seal has a radially extendible elastomeric sealing surface;

wherein the tubular body comprises a downhole degradable metal, wherein the downhole degradable metal is a doped magnesium alloy comprising from about 87% to about 97% by weight magnesium of the doped magnesium alloy and from about 0.05% to about 5% by weight dopant of the doped magnesium alloy; and responsive to tension applied to the tubular body, the slip and the seal radially extend, thereby setting the wellbore isolation device from the top within the wellbore, and wherein the downhole degradable is strong enough to be set from the top, and wherein the downhole degradable metal is selected from the group consisting of a doped WE magnesium alloy, a doped AZ magnesium alloy, a doped ZK magnesium alloy, a doped AM magnesium alloy, and any combination thereof.

10. The method of claim 9, further comprising performing a wellbore operation and degrading at least a portion of the tubular body by contacting the tubular body with an aqueous solution in the wellbore.

11. A system comprising:

a wellbore; and a wellbore isolation device comprising:

a tubular body comprising an external surface and an inner bore formed therein, wherein the tubular body has a first end and a second end, the first end to be oriented in the uphole direction of the wellbore;

a slip disposed about the external surface of the tubular body, wherein the slip has a radially extendible surface; and a seal disposed about the external surface of the tubular body, wherein the seal has a radially extendible elastomeric sealing surface; and a moveable abutment disposed on the tubular body on one side of the seal, at or near the first end of the tubular body, and a non-movable abutment disposed on the tubular body on the opposite side of the seal, at or near the second end of the tubular body;

wherein the slip and the seal radially extend responsive to tension applied to the tubular body;

wherein the wellbore isolation device is capable of being set from the top responsive to tension applied to the tubular body; and wherein the tubular body comprises a downhole degradable metal that at least partially degrades when exposed to a wellbore environment, wherein the downhole degradable metal is a doped magnesium alloy comprising from about 87% to about 97% by weight magnesium of the doped magnesium alloy and from about 0.05% to about 5% by weight dopant of the doped magnesium alloy, and wherein the downhole degradable metal is strong enough to be set from the top, and wherein the downhole degradable metal is selected from the group consisting of a doped WE magnesium alloy, a doped AZ magnesium alloy, a doped ZK magnesium alloy, a doped AM magnesium alloy, and any combination thereof.

12. The system of claim 11, further comprising a setting tool comprising:

a shear rod removably coupled with the tubular body of the wellbore isolation device; and a setting sleeve configured to engage the moveable abutment or the slip of the wellbore isolation device, wherein the shear rod is configured to apply tension to the tubular body, thereby setting the wellbore isolation device in the wellbore.

* * * * *